US006971556B2

(12) United States Patent
Shadwell et al.

(10) Patent No.: US 6,971,556 B2
(45) Date of Patent: Dec. 6, 2005

(54) PRESSURIZED AEROSOL DISPENSER

(75) Inventors: David W Shadwell, West Malling (GB); Samir Mizban, Sheffield (GB)

(73) Assignee: Aventis Pharma Limited, West Malling (GB)

( * ) Notice: Subject to any disclaimer, the term of this patent is extended or adjusted under 35 U.S.C. 154(b) by 79 days.

(21) Appl. No.: 10/485,447

(22) PCT Filed: Aug. 12, 2002

(86) PCT No.: PCT/GB02/03741

§ 371 (c)(1),
(2), (4) Date: Jan. 30, 2004

(87) PCT Pub. No.: WO03/013984

PCT Pub. Date: Feb. 20, 2003

(65) Prior Publication Data

US 2004/0210189 A1 Oct. 21, 2004

Related U.S. Application Data

(60) Provisional application No. 60/317,194, filed on Sep. 5, 2001.

(30) Foreign Application Priority Data

Aug. 11, 2001 (GB) ..... 0119643

(51) Int. Cl.[7] ..... B65D 83/00

(52) U.S. Cl. ..... 222/402.1; 222/402.2

(58) Field of Search ..... 222/402.1, 402.2

(56) References Cited

U.S. PATENT DOCUMENTS 6,129,247 A * 10/2000 Thomas et al. ..... 222/402.1
6,131,777 A * 10/2000 Warby ..... 222/402.2

* cited by examiner

*Primary Examiner*—Philippe Derakshani
(74) *Attorney, Agent, or Firm*—Paul Darkes; William Coppola

(57) ABSTRACT

A pressurized aerosol dispenser comprising a container (2) for material to be stored therein and dispensed therefrom, and a metering dispensing valve (1), said metering dispensing valve (1) comprising a generally cup-shaped metering vessel (7) held in place by means of a cap (3) fixedly mounted upon said container (2), and a sealing member (9) disposed between the metering vessel (7) and the cap (3), said sealing member (9) having an opening within which a valve stem (8) is mounted for sliding movement along a longitudinal axis, the metering vessel (7) having an open mouth, an internal surface of which defines an annular contact surface (24, 25) against which said sealing member (9) bears, wherein said contact surface (24, 25) comprises a first outwardly-flared portion (24) disposed at a first angle to said longitudinal axis and a second outwardly-flared portion (25) disposed at a second angle to said longitudinal axis, said second angle being greater than said first angle such that an annular ridge (26) is formed.

38 Claims, 11 Drawing Sheets

PRESSURIZED AEROSOL DISPENSER

CROSS REFERENCE TO RELATED APPLICATIONS

This application is a 35 U.S.C. § 371 filing of International Application No. PCT/GB02/03741 filed on Aug. 12, 2002, which claims the priority from British Application GB0119643.5 filed Aug. 11, 2001 and U.S. Provisional Application No. 60/317,194 filed Sep. 5, 2001.

This invention relates to improvements in pressurised aerosol dispensers, especially dispensers for medicaments intended for inhalation, and in particular to improvements in the sealing of metering dispensing valves in such dispensers.

Pressurised containers are commonly used to dispense products in aerosol form using a propellant which is gaseous at normal temperature and pressure, but which is maintained in liquid form inside the container by the excess vapour pressure built up inside the sealed container. The product to be dispensed may be suspended in the propellant in solid or liquid form or it may be dissolved in the propellant. Suspending agents, co-solvents, lubricants and other adjuvants may also be present in the mixture.

Metering dispensing valves are used to deliver a measured volume of the compressed propellant mixture and hence to deliver a measured quantity of the components dissolved or dispersed in the propellant. Such systems are commonly used to deliver medicaments, especially medicaments for nasal or oral inhalation.

Metering dispensing valves commonly comprise an annular metering chamber within which a valve stem is slidably mounted. The valve is fitted to the open end of a canister and sealed in position with a cover cap. When the valve stem is in a first position the chamber is open to the interior of the can and isolated from the outside of the assembly. This allows the chamber to be filled from the contents of the canister. When the valve stem is moved to a second position the chamber is isolated from the interior of the canister and opened to the atmosphere. This allows the contents of the chamber to be vented as an aerosol spray. Particularly for medical applications, it is highly desirable that the quantity of material dispensed in each actuation of the device should be the same and that the number of doses obtained should be that which is intended and specified. Effective sealing arrangements are therefore required between the valve stem and the chamber, between the chamber assembly and the cap, and between the valve and the canister, to prevent leakage of propellant and consequential inconsistency of dose and/or reduction in the number of doses obtained from the dispenser. The present invention is concerned with improvements to these sealing arrangements.

Embodiments of the Invention

[1] An embodiment of the invention provides a pressurised aerosol dispenser comprising a) a container for material to be stored therein and dispensed therefrom, and b) a metering dispensing valve;

said metering dispensing valve comprising a generally cup-shaped metering vessel held in place by means of a cap fixedly mounted upon said container, and a sealing member disposed between the metering vessel and the cap, said sealing member having an opening within which a valve stem is mounted for sliding movement along a longitudinal axis, the metering vessel having an open mouth, an internal surface of which defines an annular contact surface against which said sealing member bears, wherein said contact surface comprises a first outwardly-flared portion disposed at a first angle to said longitudinal axis and a second outwardly-flared portion disposed at a second angle to said longitudinal axis, said second angle being greater than said first angle such that an annular ridge is formed at the junction between said first outwardly-flared portion and said second outwardly-flared portion.

[2] Another embodiment of the invention provides a dispenser according to Embodiment [1], such that the annular ridge formed provides a region of increased sealing pressure, without excessively increasing the pressure applied to the valve stem that slides within the opening of the sealing member.

[3] Another embodiment of the invention provides a dispenser according to Embodiment [1], wherein the first outwardly-flared portion is disposed at an angle of between about 5° and about 30° to the longitudinal axis.

[4] Another embodiment of the invention provides a dispenser according to Embodiment [1], wherein the first outwardly-flared portion is disposed at an angle of between about 10° and about 20° to the longitudinal axis.

[5] Another embodiment of the invention provides a dispenser according to any one of Embodiments [1] to [4], wherein the second outwardly-flared portion is disposed at an angle of between about 30° and about 60° to the longitudinal axis.

[6] Another embodiment of the invention provides a dispenser according to any one of Embodiments [1] to [4], wherein the second outwardly-flared portion is disposed at an angle of between about 45° and about 55° to the longitudinal axis.

[7] Another embodiment of the invention provides a dispenser according to any one of Embodiments [1] to [6], wherein the difference between the angles at which the second and first outwardly-flared portions are disposed, relative to the longitudinal axis, is between about 20° and about 45°.

[8] Another embodiment of the invention provides a dispenser according to any one of Embodiments [1] to [6], wherein the difference between the angles at which the second and first outwardly-flared portions are disposed, relative to the longitudinal axis, is between about 30° and about 40°.

[9] Another embodiment of the invention provides a dispenser according to any one of Embodiments [1] to [8], wherein the second outwardly-flared portion is concave.

[10] Another embodiment of the invention provides a dispenser according to any one of Embodiments [1] to [9], wherein the mouth of the metering vessel includes a support surface upon which the sealing member is supported.

[11] Another embodiment of the invention provides a dispenser according to Embodiment [10], wherein the support surface is formed with a recess at the foot of the first outwardly-flared portion.

[12] Another embodiment of the invention provides a dispenser according to Embodiment [11], wherein said recess takes the form of an annular groove.

[13] Another embodiment of the invention provides a dispenser according to any one of Embodiments [10] to [12], wherein said support surface is formed integrally with said metering vessel.

[14] Another embodiment of the invention provides a dispenser according to any one of Embodiments [10] to [13], wherein said support surface is the upper surface of a support ring positioned within said metering vessel and said recess is a space between juxtaposed surfaces of said support ring and said metering vessel.

[15] Another embodiment of the invention provides a dispenser according to any one of Embodiments [8] to [14], wherein said support surface is formed with a radiussed shoulder.

[16] Another embodiment of the invention provides a dispenser according to any one of Embodiments [8] to [15], wherein the volume of said metering vessel is less than about 200 $\mu$l.

[17] Another embodiment of the invention provides a dispenser according to Embodiment [16], wherein the volume of the metering vessel is between about 30 and about 70 $\mu$l.

[18] Another embodiment of the invention provides a dispenser according to Embodiment [16], wherein the volume of the metering vessel is between about 80 and about 120 $\mu$l.

[19] Another embodiment of the invention provides a dispenser according to any one of Embodiments [1] to [18], wherein the sealing member comprises elastomeric material.

[20] Another embodiment of the invention provides a dispenser according to Embodiment [19], wherein the elastomeric material comprises material selected from the group consisting of natural and synthetic rubbers, polyolefins, polyesters, polyurethanes and silicone polymers.

[21] Another embodiment of the invention provides a dispenser substantially as herein described, with reference to FIGS. 1, 2, 4, 5, and 7.

[22] Another embodiment of the invention provides a dispenser according to any one of Embodiments [1] to [21], wherein the container contains a medicinal aerosol formulation.

[23] Another embodiment of the invention provides a dispenser according to Embodiment [22], wherein medicinal aerosol formulation comprises propellant 134*a* and/or propellant 227.

It is appreciated that certain features of the invention, which are, for clarity, described in the context of separate embodiments, may also be provided in combination in a single embodiment. Also, various features of the invention which are, for brevity, described in the context of a single embodiment, may also be provided separately or in any suitable sub-combination.

The dispenser according to the invention is advantageous primarily in that the annular ridge formed in the surface of the metering vessel against which the sealing member bears provides a region of increased sealing pressure, without increasing excessively the pressure applied to the valve stem that slides within the opening in the sealing member.

The first outwardly-flared portion may be disposed at an angle of between 5° and 30° to the longitudinal axis, or between 10° and 20°, e.g. 15°, and the second outwardly-flared portion at an angle of between 30° and 60°, or between 45° and 55°, e.g. 48°.

The difference between the angles at which the second and first outwardly-flared portions are disposed, relative to the longitudinal axis, may be between 20° and 45°, or between 30° and 40°.

The first and second outwardly-flared portions may be flat, or one or both may not be flat, instead being curved. Where one or both of the first and second outwardly-flared portions are curved, the curves may be characterised by a tangent or chord disposed at the relative angles to the longitudinal axis described above. The arrangement may be such that the first outwardly-flared portion is flat and the second outwardly-flared portion is concave, ie arcuate in profile.

The mouth of the metering vessel may include a support surface upon which the sealing member is supported. Such a support surface may be formed with a recess at the foot of the first outwardly-flared portion of the contact surface. Such a recess will normally extend all the way around the mouth of the metering vessel and will thus have the form of an annular groove. The groove is preferably shaped in such a way as to promote flow of the material of the sealing member into the groove, so as to further enhance the sealing effect of the sealing member. To achieve this, the support surface may be provided with, or take the form of, a radiussed shoulder.

The support surface will generally be disposed substantially orthogonally to the longitudinal axis. The support surface may be formed in the metering vessel itself, eg as a ledge or the like. Alternatively, the support surface may be a surface of an intermediate component that is received within the open mouth of the metering vessel. Such an intermediate component may be a support ring that is itself supported on a ledge formed within the metering vessel.

Apart from the inventive modifications described above, the aerosol dispenser according to the invention may be generally conventional, in terms of the form of the components incorporated in it, their dimensions and the materials from which they are manufactured.

The invention will now be described in greater detail, by way of illustration only, with reference to the accompanying drawings, in which.

Figure 1:
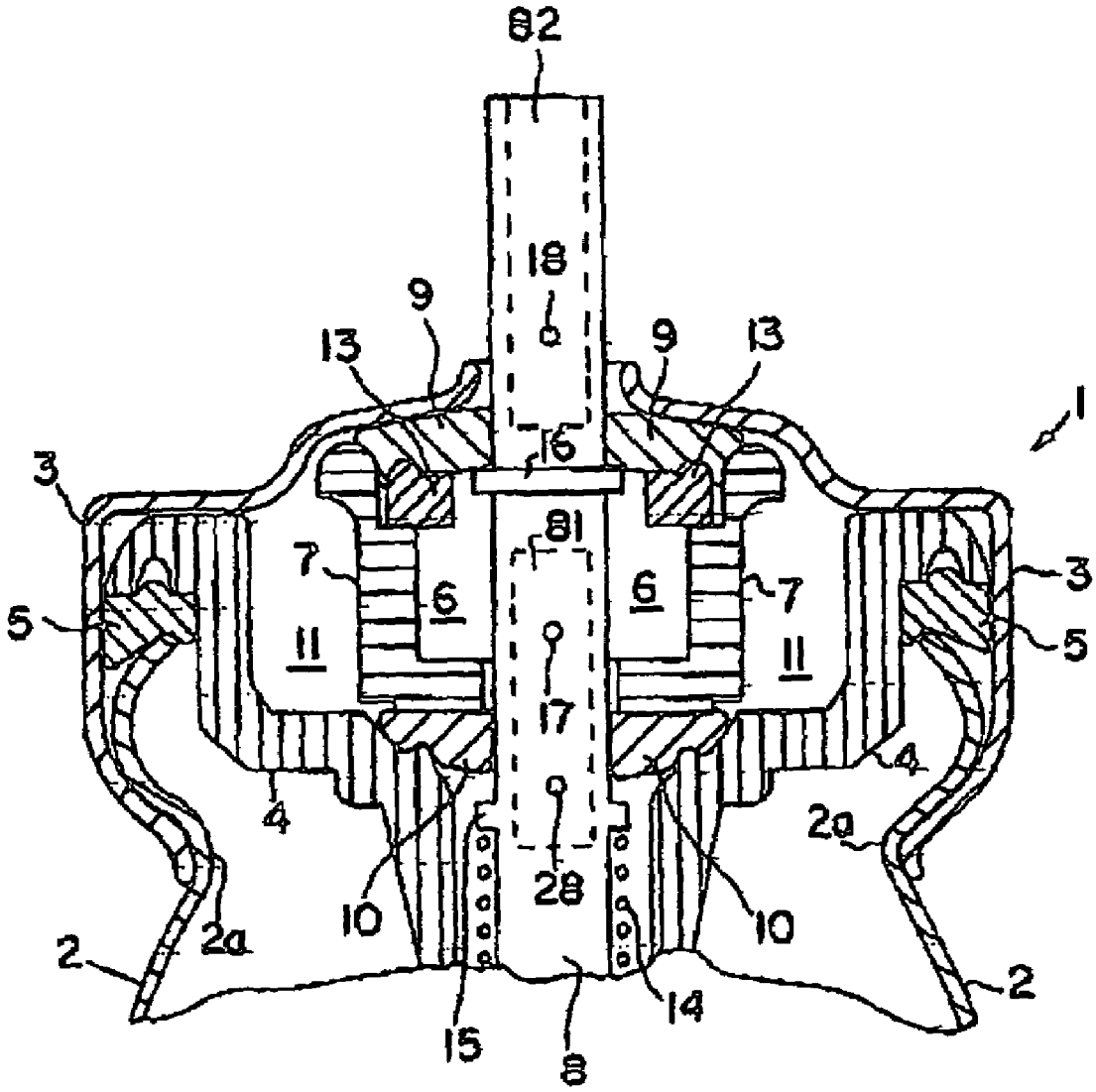
FIG. 1 is a view, partially in cross-section, of the upper part (including a valve assembly) of a first embodiment of a pressurised aerosol medicament dispenser according to the present invention.

Referring first to FIG. 1, there is shown in cross-section the upper part, including a top valve assembly (1), of a pressurised medicinal aerosol dispenser. Apart from the inventive modifications described below and illustrated in the more detailed FIGS. 2 and 4 (but not immediately apparent in FIG. 1), the assembly shown is typical of the general construction of such an aerosol dispenser.

The top valve assembly (1) is fitted to the open end of a generally cylindrical aerosol can (2). The open end of the can (2) is formed with a neck (2*a*) just below the open end, and the top valve assembly (1) is held in position by a cap (3), which is crimped over the neck (2*a*) of the can (2).

The valve assembly (1) comprises a body (4) which is held in position over the end of can (2). An annular gasket (5) is interposed between the body (4) and the can (2) and is compressed to form a seal, preventing escape of aerosol propellant held in the can (2) between the body (4) and the rim of the can (2).

The body (4) contains a generally cylindrical recess (11) within which a metering vessel (7) is accommodated. The body (4) is formed with ribs (not shown) which extend inwardly into the recess (11) to facilitate positioning of the metering vessel (7) within the recess (11). The metering vessel (7) takes the form of a generally cylindrical cup, the base of which has a central opening through which a valve stem (8) is slidably received, as described below. In the open upper end of the vessel (7) a recess is formed into which a support ring (13) fits loosely. Above the support ring (13) an upper seat gasket (9) closes the mouth of the metering vessel (7). As will be apparent from consideration of the embodiment of the invention shown in FIG. 5 and described below, a support ring is not always necessary and in such cases the recess will be somewhat shallower and accommodate the upper seat gasket (9) directly.

The valve stem (8) extends axially through the vessel (7), passing through the opening in the base, and through openings in the upper seat gasket (9), and a lower seat gasket (10) interposed between the base of the metering vessel (7) and the body (4). The upper and lower seat gaskets (9,10) make sealing contact with the valve stem (8) such that the vessel (7), upper seat gasket (9), support ring (13), lower seat gasket (10) and valve stem (8) define an annular chamber (6) which is dimensioned in such a way to to contain the required volume of aerosol product to be dispensed in a single actuation of the dispenser by a user.

As stated above, the upper end of the metering vessel (7) is closed by the upper seat gasket (9). This is compressed between the cap (3), the upper seat support ring (13), the upper region of the metering vessel (7) and the valve stem (8), thereby sealing the annular metering chamber (6). The upper seat gasket (9) forms a seal against the valve stem (8), in the same way as the lower seat gasket (10), preventing leakage of propellant mixture from the annular chamber (6) past the valve stem (8) to the external atmosphere.

The valve operates as follows. At rest, a spring (14) acts upon a shoulder (15) on the valve stem (8) and maintains the valve stem (8) in the position shown in FIG. 1. In this position, the annular chamber (6) is in fluid communication with the aerosol can (2) via a first hollow interior portion (81) of the valve stem (8), a first orifice (17) formed in the lower part of the valve stem (8) that resides within the chamber (6) and a second orifice (28) formed in the part of the valve stem (8) that is located below the lower seat gasket (10). This allows the annular chamber (6) to fill with propellant mixture when the dispenser is inverted. To operate the dispenser, the valve stem (8) is depressed, against the action of the spring (14), towards the can (2). This causes the first orifice (17) to pass the lower seat gasket (10), thereby isolating the annular chamber (6) from the can interior. Further depression of the valve stem (8) brings a third orifice (18), which opens into a second hollow interior portion (82) of the valve stem (8), into the metering chamber (6). The contents of the chamber (6) are then able to vent to the exterior via the third orifice (18) and the second hollow portion (82) of the valve stem (8).

Movement of the valve stem (8) relative to the rest of the dispenser is limited by an annular stop (16) formed integrally with the valve stem (8). In the FIG. 1 position, the stop (16) abuts the underside of the upper seat gasket (9). Depression of the valve stem (8) is restricted by abutment of the stop (16) with the base of the metering vessel (7).

Release of the valve stem (8) causes it to return to the FIG. 1 position, under the action of the spring (14). The third orifice (18) passes through the central opening in the upper seat gasket (9), thereby once again isolating the chamber (6) from the external environment.

The present invention is concerned with improvements to the sealing of the chamber (6) against unwanted leakage, and in particular with improvements to the sealing arrangements between the top seat gasket (9) and the metering vessel (7). The improvements made to a first embodiment of an aerosol dispenser are shown in greater detail in FIGS. 2 and 4, with FIG. 3 being provided for comparison with a typical prior art arrangement. In all arrangements illustrated, corresponding components are identified by corresponding reference numerals.

Figure 3:
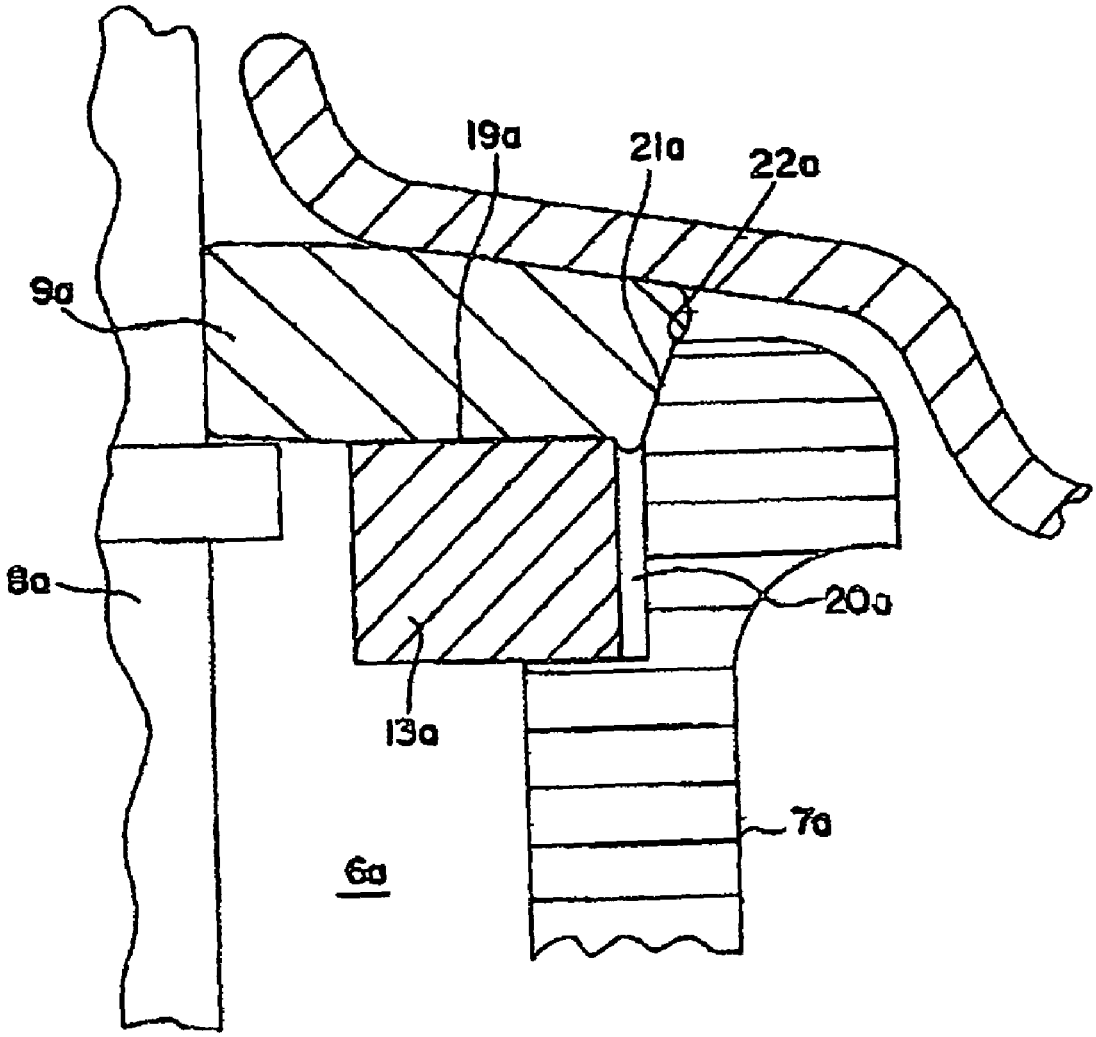
FIG. 3 Prior Art
FIG. 3 is a view similar to FIG. 2 of an assembly according to the prior art.

FIG. 3 is a detailed view of the upper seat gasket region of a prior art aerosol dispenser. It can be seen that propellant contained in the annular chamber (6*a*) can potentially leak out in a number of ways. It can leak out between the upper seat gasket (9*a*) and the valve stem (8*a*). It can leak past the bottom of the support ring (13*a*), through a gap (20*a*), and through the contact region (21*a*) between the upper seat gasket (9*a*) and the wall of the metering vessel (7*a*). Finally, it can leak between the upper seat gasket (9*a*) and the top surface (19*a*) of the support ring (13*a*) and then past the contact region (21*a*) between the upper seat gasket (9*a*) and the wall of the metering vessel (7*a*) as before.

As can be seen from FIG. 3, the prior art sealing arrangement utilises a support ring (13*a*) with a flat upper surface (19*a*) and has an angled flat face on the wall of the metering vessel (7*a*) at the contact region (21*a*). When the upper seat gasket (9*a*) is pressed into position during valve assembly, it deforms as shown to form a reasonable seal at the top (22*a*) of the contact region (21*a*). However, the contact between the upper seat gasket (9*a*) and the top surface (19*a*) of the support ring (13*a*) and the contact between the upper seat gasket (9*a*) and the wall of the metering vessel (7*a*) at the contact region (21*a*) may not provide fully effective seals because there is relatively little pressure generated between the areas of flat surface in contact. In contrast the pressure at the top (22*a*) of the contact region (21*a*) is more significant and provides a reasonable seal in that area. However, because the area of contact in this region is extremely limited it may not be sufficient to provide a permanent and reliable sealing capability. The seal is particularly vulnerable to failure by defects or foreign bodies in the sealing region.

It is important to note that simply increasing the compressive forces applied to the upper seat gasket (9*a*) will not generally be a satisfactory way of improving the sealing efficiency as, although the quality of the seals between the upper seat gasket (9*a*), support ring (13*a*) and metering vessel (7*a*) would be expected to be improved by such a measure, the pressure exerted by the upper seat gasket (9*a*) on the valve stem (8*a*) may then be too great to allow free movement of the valve stem (8*a*).

Figure 2:
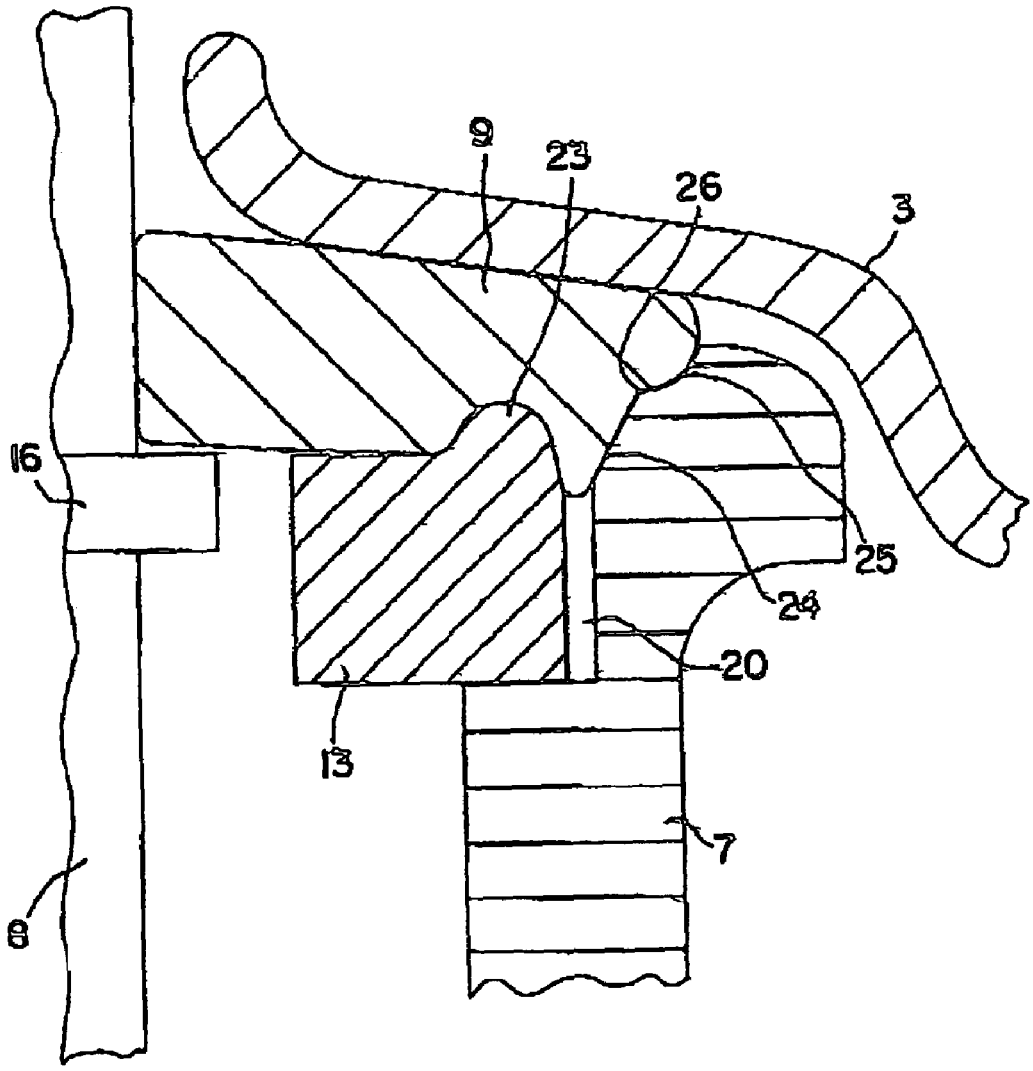
FIG. 2 is a view on an enlarged scale of a top seat assembly forming part of the dispenser of FIG. 1.
Figure 4:
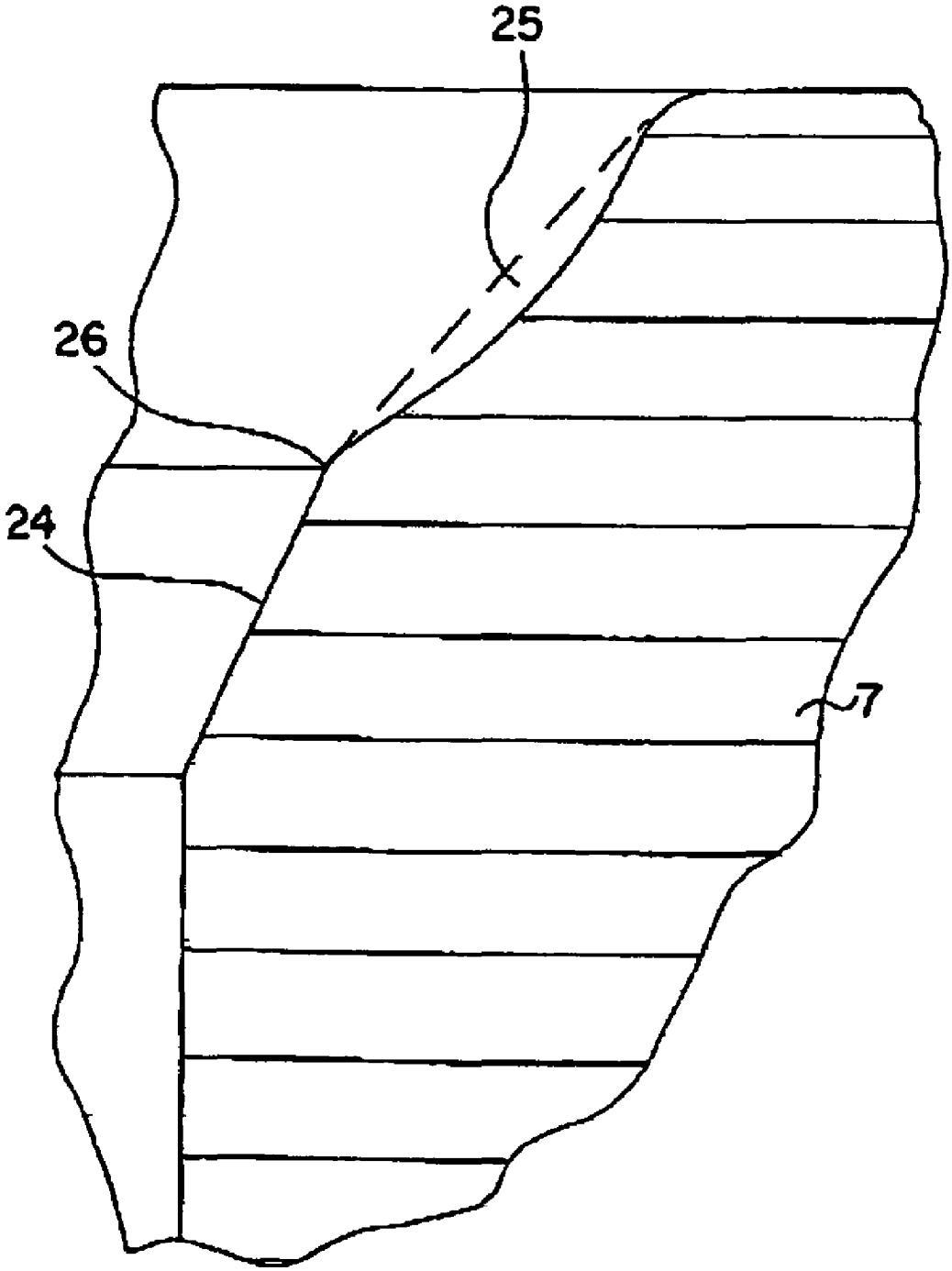
FIG. 4 is a detailed view, on a further enlarged scale, of the profile of the mouth of a metering vessel forming part of the top seat assembly of FIG. 2.

These problems are overcome or substantially mitigated by the sealing arrangement of the present invention as shown in FIG. 2 and FIG. 4. Two changes are made:

First, as shown most clearly in FIG. 4, the lower part (24) of the wall of the metering vessel (7) against which the upper seat gasket (9) bears is angled away from the vertical axis towards the outside of the can as shown. The upper part (25) of the wall of the metering vessel (7) is angled away from the vertical axis at a greater angle. This creates a pressure-forming annular ridge (26). The surface of the upper part (25) is also curved in the form of an arc, whose chord (shown by the broken line in FIG. 4) describes the required angle to form the annular ridge (26). The annular ridge (26) acts as a pressure raiser for the outside of the upper seat gasket (9) to seal against. The result is an increase in the effective area of contact between the upper seat gasket (9) and the wall of the metering vessel (7) over which an effective seal pressure can form. Radial seal pressures are increased and the seal is less vulnerable to failure by defects or foreign bodies in the sealing region.

The arcuate form of the upper part (25) also helps the material of the upper seat gasket (9) to flow more freely in the gap between the top of the metering vessel (7) and the cap (3), increasing the sealing contact area.

Secondly, the upper surface of the support ring (13) is formed, adjacent its outer edge, with a radiussed shoulder (23)—see FIG. 2. The effect of the shoulder (23) is to define, between the shoulder (23) and the angled face (24) of the metering vessel (7), a tapered recess leading into the gap (20) between the support ring (13) and the metering vessel (7), and into which the material of the upper seat gasket (9) can flow.

With this combination of features the deformation of the upper seat gasket (9) under compression is changed from that of the prior art assembly shown in FIG. 3 to that shown in FIG. 2. The radial shoulder (23) on support ring (13) and the angled face (24) force the material of the upper seat gasket (9) to deform and flow into the gap (20) as the dispenser is assembled by crimping of the cap (3) over the neck of the can (2). This forms an effective seal between the upper seat gasket (9), the support ring (13) and the metering vessel (7). The material of the upper seat gasket (9) also deforms over the annular ridge (26) and a second effective radial seal is formed at that point.

A further advantage is that the tendency for the pressure exerted by the cap (3) on the upper seat gasket (9) to compress the upper seat gasket (9) against the valve stem (8) is reduced. This allows better control of this pressure which is transmitted through the gasket material to the central opening through which the valve stem (8) moves. This pressure must be balanced between a pressure high enough to form an effective seal but low enough to allow the valve stem (8) to move freely.

Figure 5:
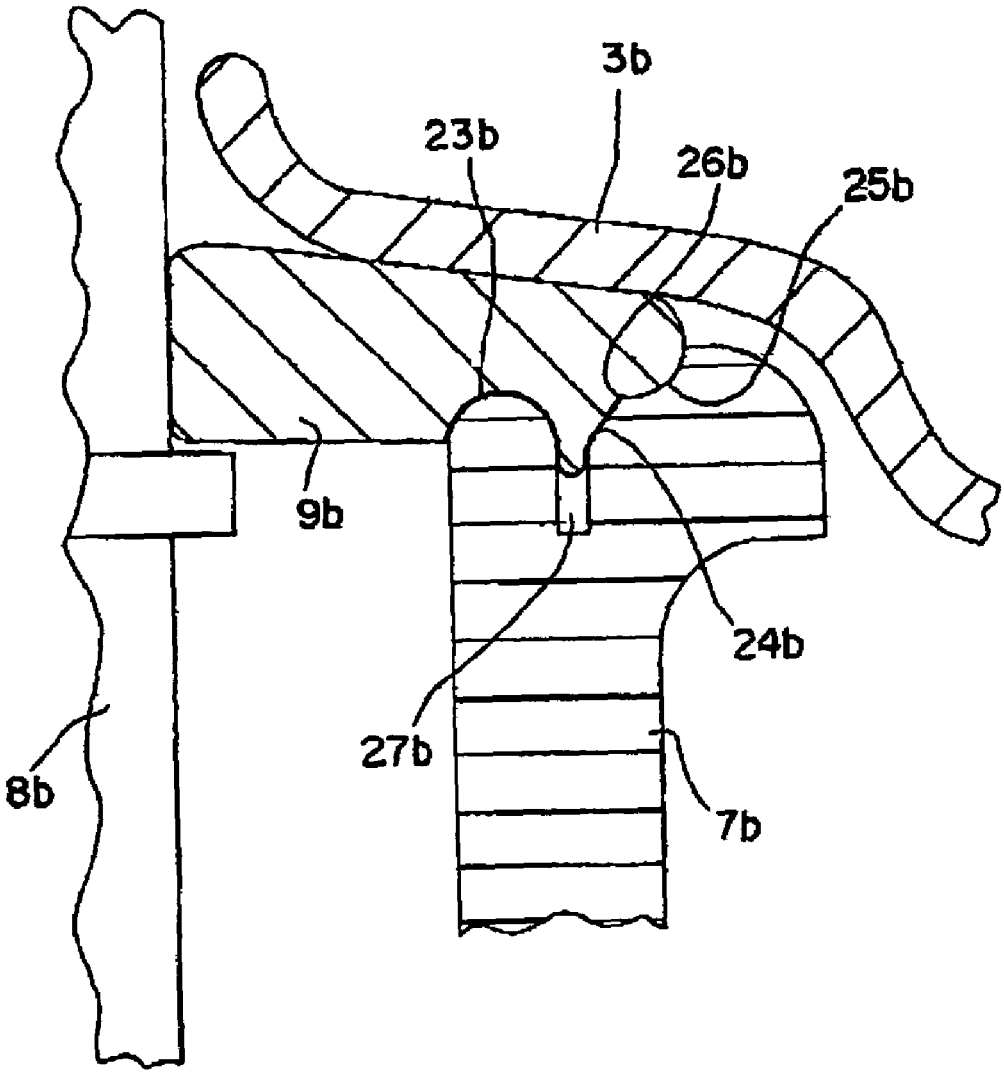
FIG. 5 is a view similar to FIG. 2 of a top seat assembly forming part of a second embodiment of a medicament dispenser according to the invention.
Figure 6:
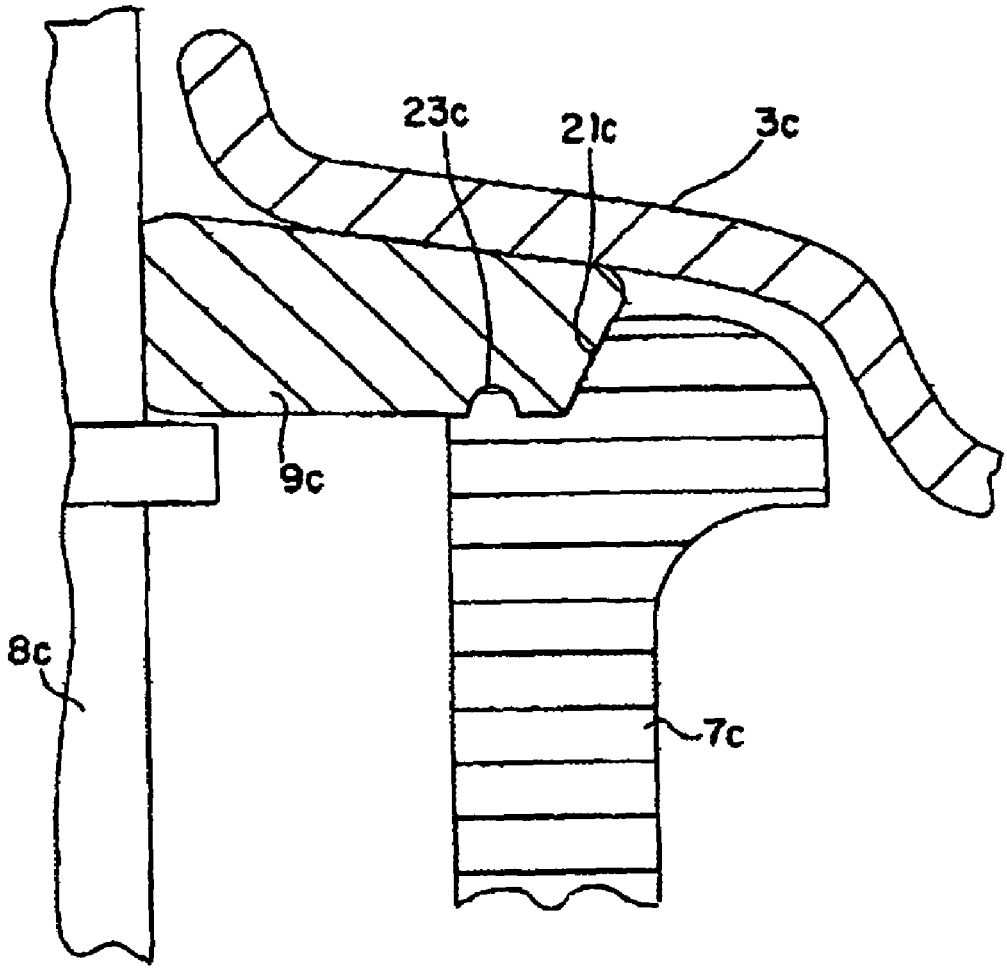
FIG. 6 Prior art
FIG. 6 is a view similar to FIG. 5, but of a valve according to the prior art.

FIG. 5 shows a view similar to FIG. 2 of a second embodiment of the invention, and FIG. 6 is a similar view of a corresponding prior art arrangement.

The valve of FIG. 5 differs from the first embodiment of the invention, shown in FIG. 2, and the prior art valve of FIG. 6 from that shown in FIG. 3, in that they have no separate support ring. Instead, the support ring is in effect incorporated into the wall of the metering vessel (**7*b*,7*c*) and the recess at the top of the metering vessel (7*b*,7*c*) that receives the upper seat gasket (9*b*,9*c*) is shallower. Such a construction could typically be used for valves with a smaller metering chamber volume. The arrangement of the lower seat gasket, the metering vessel and the other components in the valve assembly may be as described in relation to FIG. 1**.

In the prior art valve shown in FIG. 6, a raised shoulder (**23*c*) is provided on the top surface of the recess on which the upper seat gasket (9*c*) is received. The contact region (21*c*) between the upper seat gasket (9*c*) and the metering vessel (7*c*) is flat, as in the prior art valve shown in FIG. 3**.

The second embodiment of the invention, shown in FIG. 5, incorporates modifications with respect to the prior art arrangement of FIG. 6 that are similar to those described above for the first embodiment of the invention in relation to the prior art arrangement of FIG. 3. The surface of the metering vessel (**7*b*) that supports the upper seat gasket (9*b*) is formed with a radiussed shoulder (23*b*) and a channel (27*b*) into which the upper seat gasket (9*b*) can deform. The channel (27*b*) performs the same function as the gap (20) in the first embodiment (FIG. 2), and need only be deep enough to allow the upper seat gasket (9*b*) to deform freely. The contact region between the upper seat gasket (9*b*) and the metering vessel (7*b*) is modified in a similar way to that shown in FIG. 4 and described above. The lower part (24*b*) of the wall of the metering vessel (7*b*) against which the upper seat gasket (9*b*) bears is angled away from the longitudinal axis of the valve assembly. The upper part (25*b*) is disposed at a greater angle and is concave. An annular ridge (26*b*) is formed at the junction between the lower part (24*b*) and the upper part (25*b***).

Figure 7:
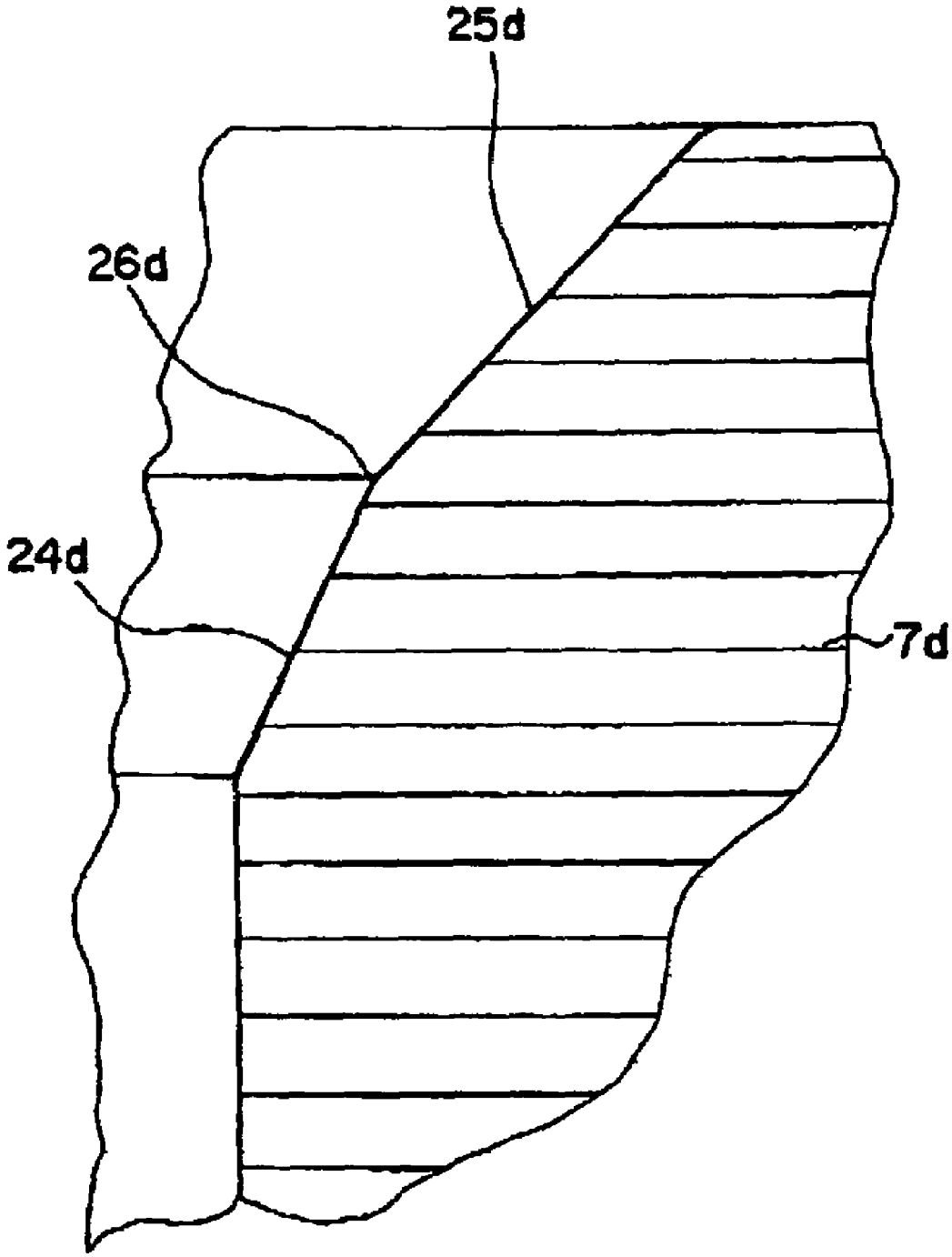
FIG. 7 is a view similar to FIG. 4, showing the profile of the mouth of the metering vessel forming part of a third embodiment of the invention.

Finally, the embodiment shown in FIG. 7 is identical to that of FIGS. 1, 2 and 4, save that the upper part (**25*d*) of the wall of the metering vessel (7*d*) against which the upper seat gasket (not shown in FIG. 7**) bears is flat, rather than concave.

The upper seat gasket may be made of any suitable elastomeric material. The material must be compatible with the propellants and other ingredients of the aerosol to be used. Typical materials include natural and synthetic rubbers, polyolefins, polyesters, polyurethanes and silicone polymers.

Valves may be produced to the above specifications in any volume suitable for use in metered dose aerosol canisters. Typically such valves have a volume less than 200 $\mu$l, preferably between 20 $\mu$l and 120 $\mu$l. Valves according to the first embodiment of the invention, comprising an upper seat support ring, will typically be of higher volume, preferably between 80 $\mu$l and 120 $\mu$l. Valves according to the second embodiment of the invention will typically be of lower volume, preferably less that 100 $\mu$l and more preferably between 30 $\mu$l and 70 $\mu$l.

The present invention is further exemplified but not limited by the following illustrative examples that illustrate aerosol dispensers according to the invention.

Finite Element Analysis of Valves

The Finite Element Analysis (FEA) study was carried out to provide an understanding of valve components during assembly and usage processes. Computer models were established to give full description of contact pressure and distortion particularly between rubber seats and adjacent components. The objective of the study was to apply the predictive model(s) to valve leakage improvement and assess possible design modifications. Further development was also performed to achieve alternative design enhancement for a different range of propellant volumes.

A systematic approach was followed for the study in order to establish a practical route of investigation, starting with an analysis of an existing design, which gave an indicative prediction of overall weakness of leakage paths. The analysis resulted in further development and more detailed modelling work in relation to effective design changes.

FEA Software

MSC.Marc finite element analysis software was used for the study and is quality assured with ISO 9001 certification [MSC.Software Corporation, 2 MacArthur Place, Santa Ana, Calif. 92707, MSC.Marc User's Guide, Version 2001]. This general-purpose non-linear program is sophisticated for working with contact behaviour and rubber deformation processes, as well as other engineering analyses. The program is also capable of modelling surface interactions, such as the automated solution of problems where contact occurs between a deformable and a rigid body or between multiple deformable bodies. MSC.Marc offers various approaches to model non-linear elastomeric material with different methods including a third-order-deformation strain energy function, for both incompressible and nearly incompressible behaviour. MSC.Marc's pre-post processing code Mentat was used to construct FEA mesh, by importing components drawing geometries through Dxf format files, model input data, boundary conditions, analysis type and result plots.

Model Description

Axi-symmetric non-linear contact analysis of valve assembly including can interface, was developed for the defined supports, assembly and operational conditions. Meshes were constructed from the imported Dxf drawing files supported by metrology laboratory measurements, supplied by Aventis Pharma Ltd, for the critical parts of component interactions. The properties of rubber seats, plastic parts and aluminium were supplied by the materials manufacturers and Aventis Pharma Ltd. Young's Modulus, Poisson's Ratio and Yield Stress values were used for the plastic and aluminium parts [Speciality Steel & Forge, Fairfield, N.J., Aluminium 5005-0 and Aluminium 5052-0; MatWeb database, Polybutylene Terephthalate (PBT) Arnite T06-202; Ticona GmbH, D-65926 Frankfurt am Main, Ticona Celcon M90 Acetal copolymer (POM)]. For the rubber components, tensile test data of stress strain curve were supplied by materials supplier [Bespak Europe, King's Lynn, Norfolk PE30 2JJ, England, Tensile test RB190NT Nitrile rubber] and input into MSC.Marc/Mentat program. Elastomeric material constants were then obtained and used in the strain energy function. The three-term series of Mooney-Riviin model was considered for the rubber analysis [MSC.Software Corporation, 2MacArthur Place, Santa Ana, Calif. 92707, MSC.Marc Volume A: Theory and User Information, Version 2001]. The boundary conditions were applied, as in the assembly process, by fully supporting the ferrule (fixed in assembly direction) where the valve body is being pushed home behind the ribs. The crimping phase takes place by deforming the ferrule against the can neck as the gasket will be depressed due to the valve being pushed onto the can. A spring force of 20 Newton, as supplied, was maintained in the assembled valve components. Materials deformation, contact and frictional forces were then calculated due to valve components distortion and surface interactions.

A systematic approach was followed with series of single and multiple component design changes to improve valve performance, until the optimum modification was achieved. The finite element mesh was refined at various stages to improve model accuracy particularly in the parts of design changes and rubber seats. Stress and displacement values of distorted geometries were obtained throughout the valve to assess the level of improvement, with the emphasis on the normal contact pressure and rubber flow between seats and adjacent components.

Figure 9:
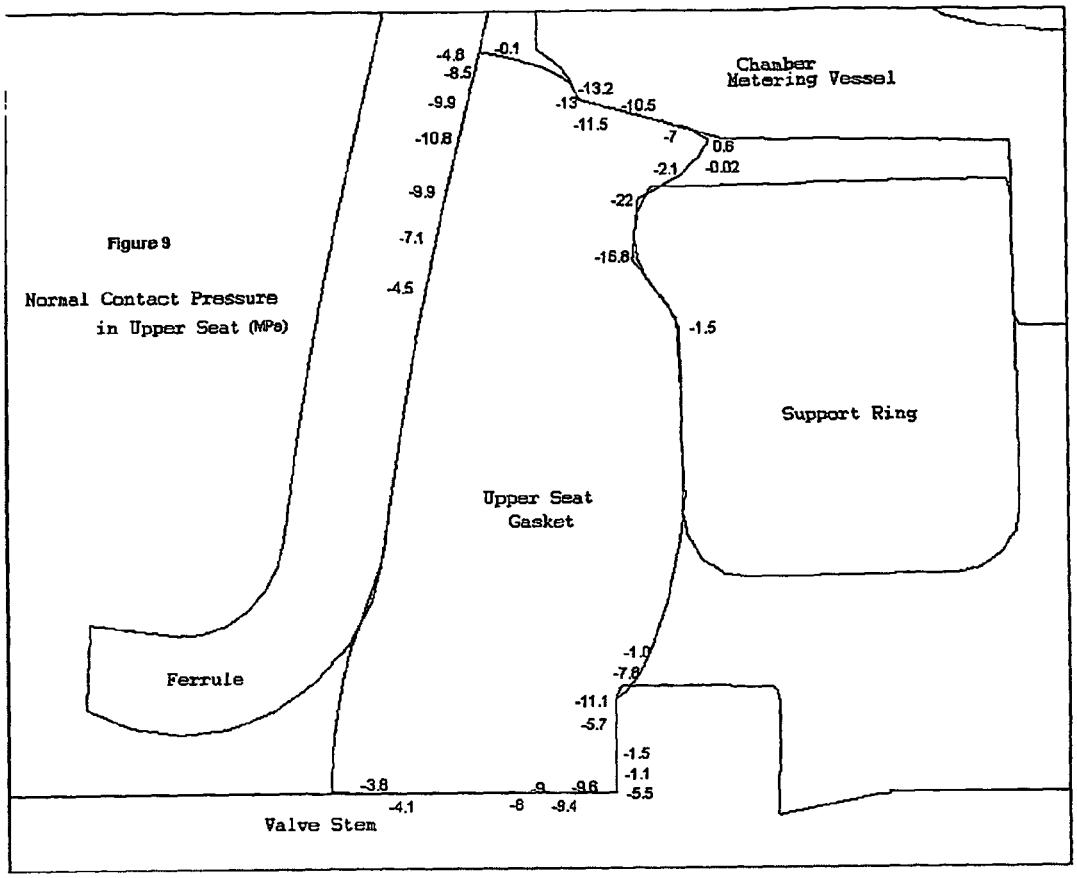
FIG. 9 is a graphical representation of the Modified Design 1 valve indicating the normal contact pressure (Mpa) of the upper seat gasket with its neighbouring components.
Figure 10:
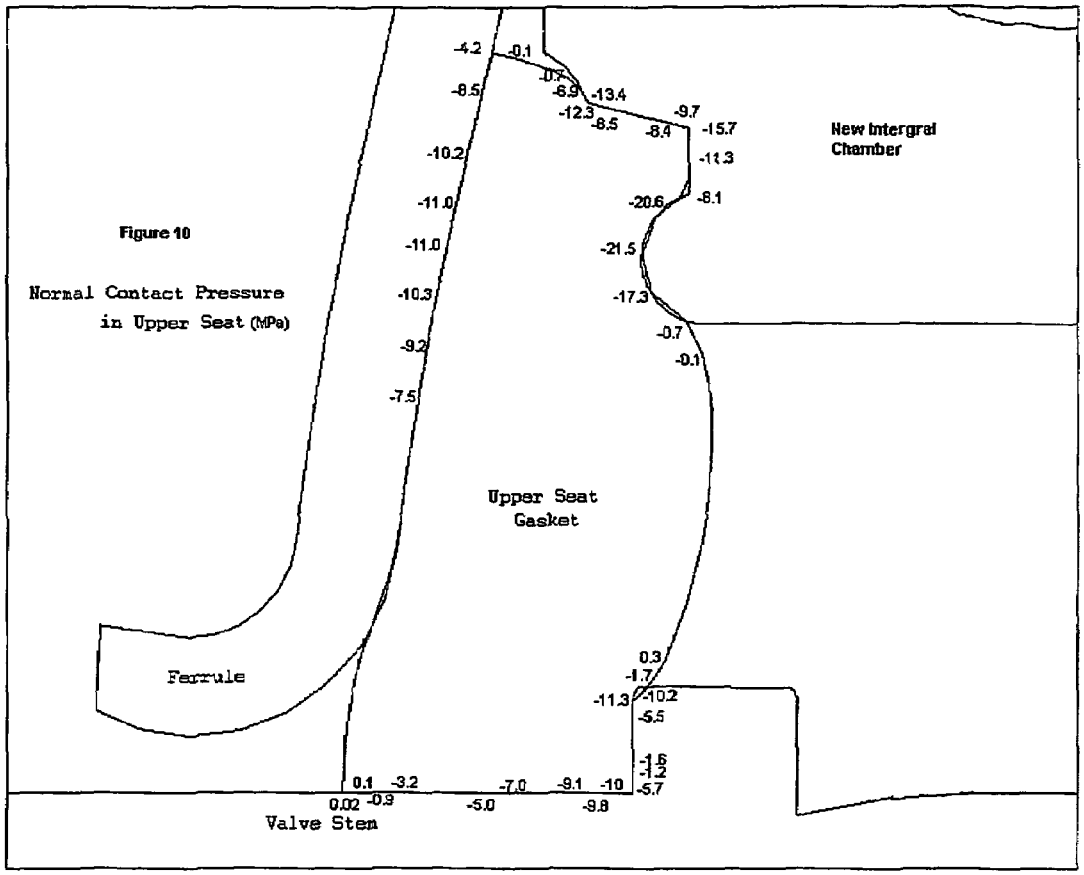
FIG. 10 is a graphical representation of the Modified Design 2 valve indicating the normal contact pressure (Mpa) of the upper seat gasket with its neighbouring components.

After many trials of design alterations three models were constructed and finalized for the analysis:

1. Original Design: This analysis is for a known valve currently in use. It was used to compare with the modified design and model validation. The top of the metering chamber vessel and the support ring form a sealing zone by deforming the upper seat gasket when pushed against the ferrule 'cover cap', as the valve is being assembled. The contact surface of both the metering chamber and the support ring with the upper seat are flat which may result in less effective sealing pressure, leading to a possible leakage path. The interaction between support ring and metering chamber can also be ineffective regarding leakage, which is due to the fact that both components are plastic material and do not have the elastomeric property of rubber. Hence, the main sealing zone for this type of design will be between the chamber metering vessel and upper seat gasket, depending on the level of pressure generated when valve is being assembled. Furthermore, current analysis may not allow better flow of the upper seat rubber gasket material in the gaps that exist next to the sealing domain, which would decrease the contact sealing area and pressure distribution. See FIG. 8.
2. Modified Design 1: This design was developed to include modifications to the Original Design, discussed above, to make minor alterations so as to improve the contact pressure and rubber flow at expected leakage zones. The top surface of the metering chamber, against the upper seat gasket, is profiled with a curve cut-out edge rather than a flat edge. This new modified surface then comprises a first outwardly-flared portion and a second concave that is flared outwardly at a greater angle than the first portion, forming an annular ridge at the junction between both portions. The alteration provides a region of increased contact pressure with the upper seat gasket's outside diameter, without excessively increasing the pressure against the valve stem that is required for device function. The support ring has also been modified by adding material of radial profile at the top edge beneath the chamber metering vessel and against the upper seat gasket. This modification has dual benefits, namely; increasing the pressure with upper seat and also improving upper seat outside diameter rubber flow beneath chamber. See FIG. 9.
3. Modified Design 2: This analysis is similar to the above Modified Design 1 with additional modifications to integrate the support ring with the metering chamber vessel so as to become one single integrated component "the new integral chamber". The new integral chamber was created by cutting off the internal support ring profile to coincide with the chamber metering vessel's internal diameter and joining the support ring and chamber making vessel at their contact areas and filling in the recess part where rubber flows from the upper seat gasket, when compressed (between support ring outside diameter and the inside diameter of chamber metering vessel metering vessel top part). The aim was to introduce additional improvements and innovations to the new design technology and be adaptable to conform to any valve aerosol capacity (e.g., 20 to 120 microlitre). Improvements were made to modify the radial profile of the new integrated support ring into full radius indentation, and eliminate the sharp contact corners, where indents into the rubber, and blend them smoothly with the radial profile. The recess was made shallower by integrating the support ring further with the chamber. Although the area of contact between the seat and the support is largely reduced, enhancements were made to retain seat pressure against the chamber and radial ring profile, and improve the rubber flow and locking in the recess. Furthermore, as the support ring is integrated with the chamber no leakage path is now possible in this zone. See FIG. 10.

Results Discussion

Figure 8:
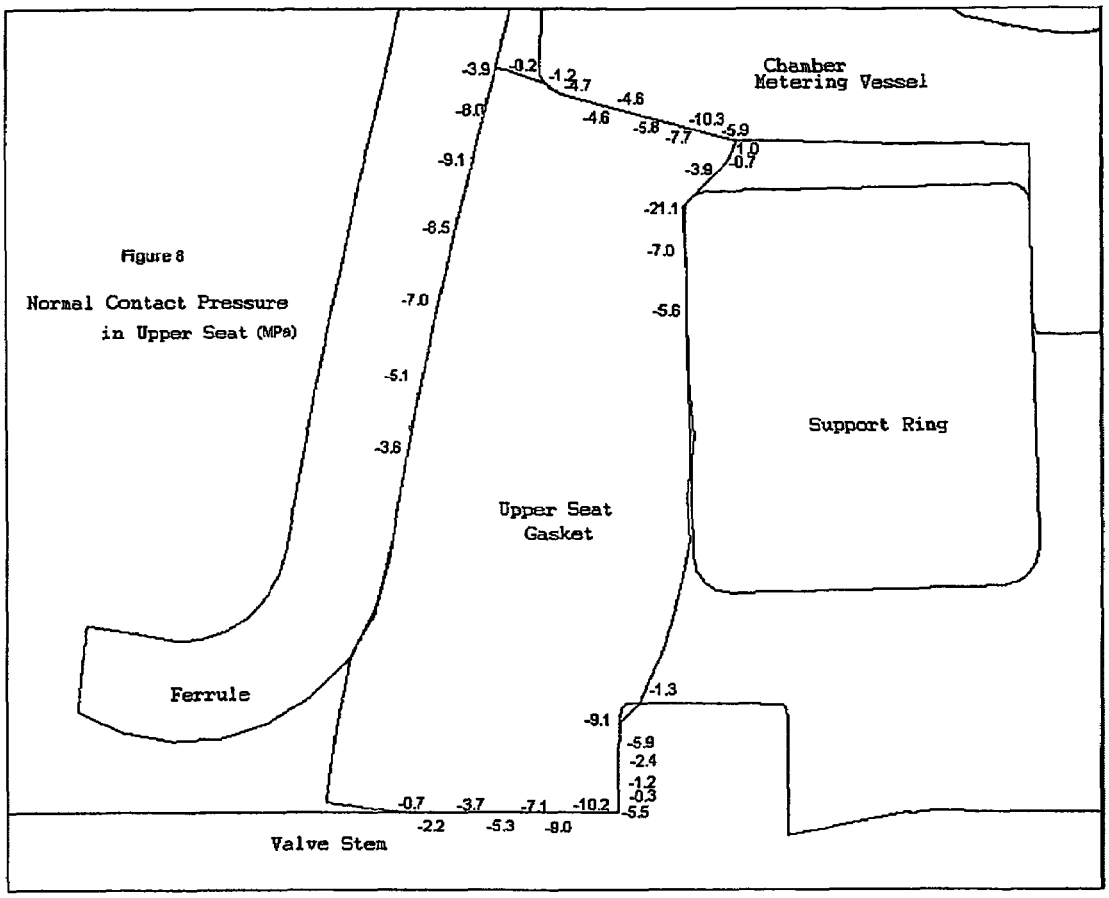
FIG. 8 is a graphical representation of a known valve indicating the normal contact pressure (Mpa) of the upper seat gasket with its neighbouring components.

For both Modified Designs 1 and 2(FIGS. 9 and 10) the normal contact pressure between the upper seat gasket and the metering chamber vessel witnessed a 30% increase over the existing design (FIG. 8). The higher pressure in both modified designs has spread over a larger contact zone; comparing to the smaller contact zone in the existing design (FIG. 8), which will improve further sealing behaviour. This can also be seen between the new support ring (FIG. 9) or the new integral chamber (FIG. 10) and the upper seat gasket. Contact sealing pressure in the modified designs (FIGS. 9 and 10) was improved against the ferrule by about 20% over the original design (FIG. 8).

The material flow of upper seat gasket rubber was improved beneath the new modified chamber profile (FIGS. 9 and 10) in two directions, towards the ferrule and above the support ring, which further enlarges the contact sealing surface.

It is important to note that while improving the sealing pressure between rubber seat gasket and the other neighbouring components, the pressure on the valve stem (core) was closely monitored and maintained at a similar level. This is to ensure that valve function during operation remains unaffected by design improvements, as it can be seen in FIGS. 8, 9 and 10 where the maximum value of normal pressure between valve stem and upper seat is kept at around 10 MPa.

Model Validation

Figure 11:
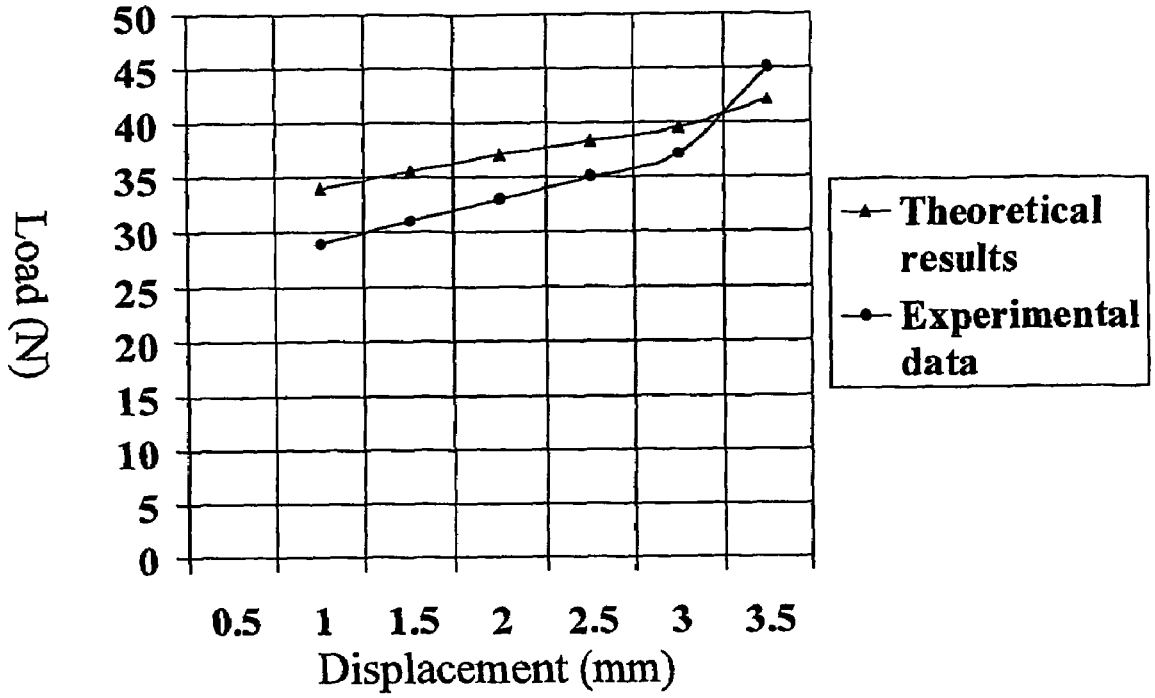
FIG. 11 is a graph indicating the comparison between practical and FEA theoretical data of reaction forces during stem depression in a valve.

The finite element model was validated against experimental data by calculating reaction forces due to valve stem depression, as shown in FIG. 11. The valve stem (core extension) was pushed in at the end of the complete valve/can distorted assembly. The comparison percentage error between 5–15% was shown. However, at the normal valve function where stem is usually depressed around 3 mm the error is at the lower end, about 5%. This numerical error is expected due to certain assumptions required for finite element analysis and the lack of precise information on other properties such as friction coefficient values and work hardening, and the exclusion of propellant effect.

During the development study other assessments were observed which have two indications suggesting that the FEA model is predictive, namely:

(1) the addition of the high compression step (instead of flat base), at the base of chamber, predicted an increase in effective seal pressure as previously experienced by Aventis in their development phase in leakage reduction; and (2) the excessive stress concentration between body cut-out corner and gasket component, as seen in valve split examination by Aventis.

The finite element analysis has shown that leakage can best be controlled in the up-stream flow by improving the contact pressure between rubber seats and adjacent components and more effectively between upper seat and chamber top and support ring. The two modified designs have shown that improvements can be made with minimum alterations to the existing valve design.

The present invention may be embodied in other specific forms without departing from the spirit or essential attributes thereof.

What is claimed is:

1. A pressurised aerosol dispenser comprising a container (2) for material to be stored therein and dispensed therefrom, and a metering dispensing valve (1);

said metering dispensing valve (1) comprising a generally cup-shaped metering vessel (7) held in place by means of a cap (3) fixedly mounted upon said container (2), and a sealing member (9) disposed between the metering vessel (7) and the cap (3), said sealing member (9) having an opening within which a valve stem (8) is mounted for sliding movement along a longitudinal axis, the metering vessel (7) having an open mouth, an internal surface of which defines an annular contact surface (24,25) against which said sealing member (9) bears, wherein said contact surface (24,25) comprises a first outwardly-flared portion (24) disposed at a first angle to said longitudinal axis and a second outwardly-flared portion (25) disposed at a second angle to said longitudinal axis, said second angle being greater than said first angle such that an annular ridge (26) is formed at the junction between said first outwardly-flared portion (24) and said second outwardly-flared portion (25).

2. The dispenser as claimed in claim 1, wherein the first outwardly-flared portion (24) is disposed at an angle of between 5° and 30° to the longitudinal axis, and the second outwardly-flared portion (25) at an angle of between 30° and 60°.

3. The dispenser as claimed in claim 1, wherein the first outwardly-flared portion (24) is disposed at an angle of between 10° and 20° to the longitudinal axis, and the second outwardly-flared portion (25) at an angle of between 45° and 55°.

4. The dispenser as claimed in claim 1, wherein the difference between the angles at which the second and first outwardly-flared portions (25,24) are disposed, relative to the longitudinal axis, is between 20° and 45°.

5. The dispenser as claimed in claim 1, wherein the difference between the angles at which the second and first outwardly-flared portions (25,24) are disposed, relative to the longitudinal axis, is between 30° and 40°.

6. The dispenser as claimed in claim 1, wherein the second outwardly-flared portion (25) is concave.

7. The dispenser as claimed in claim 1, wherein the mouth of the metering vessel (7) includes a support surface upon which the sealing member (9) is supported.

8. The dispenser as claimed in claim 7, wherein the support surface is formed with a recess at the foot of the first outwardly-flared portion (24).

9. The dispenser as claimed in claim 8, wherein said recess takes the form of an annular groove.

10. The dispenser as claimed in claim 7, wherein said support surface is formed integrally with said metering vessel (7).

11. The dispenser as claimed in claim 7, wherein said support surface is the upper surface of a support ring (13) positioned within said metering vessel (7) and said recess is a space (20) between juxtaposed surfaces of said support ring (13) and said metering vessel (7).

12. The dispenser as claimed in claim 5, wherein said support surface is formed with a radiussed shoulder (23).

13. The dispenser as claimed in claim 1, wherein the volume of said metering vessel is less than 200 $\mu$l.

14. The dispenser as claimed in claim 13, wherein the volume of the metering vessel is between 30 and 70 $\mu$l.

15. The dispenser as claimed in claim 2, wherein the difference between the angles at which the second and first outwardly-flared portions (25,24) are disposed, relative to the longitudinal axis, is between 20° and 45°.

16. The dispenser as claimed in claim 3, wherein the difference between the angles at which the second and first outwardly-flared portions (25,24) are disposed, relative to the longitudinal axis, is between 20° and 45°.

17. The dispenser as claimed in claim 2, wherein the difference between the angles at which the second and first outwardly-flared portions (25,24) are disposed, relative to the longitudinal axis, is between 30° and 40°.

18. The dispenser as claimed in claim 3, wherein the difference between the angles at which the second and first outwardly-flared portions (25,24) are disposed, relative to the longitudinal axis, is between 30° and 40°.

19. The dispenser as claimed in claim 4, wherein the difference between the angles at which the second and first outwardly-flared portions (25,24) are disposed, relative to the longitudinal axis, is between 30° and 40°.

20. The dispenser as claimed in claim 2, wherein the second outwardly-flared portion (25) is concave.

21. The dispenser as claimed in claim 3, wherein the second outwardly-flared portion (25) is concave.

22. The dispenser as claimed in claim 4, wherein the second outwardly-flared portion (25) is concave.

23. The dispenser as claimed in claim 5, wherein the second outwardly-flared portion (25) is concave.

24. The dispenser as claimed in claim 2, wherein the mouth of the metering vessel (7) includes a support surface upon which the sealing member (9) is supported.

25. The dispenser as claimed in claim 3, wherein the mouth of the metering vessel (7) includes a support surface upon which the sealing member (9) is supported.

26. The dispenser as claimed in claim 4, wherein the mouth of the metering vessel (7) includes a support surface upon which the sealing member (9) is supported.

27. The dispenser as claimed in claim 5, wherein the mouth of the metering vessel (7) includes a support surface upon which the sealing member (9) is supported.

28. The dispenser as claimed in claim 6, wherein the mouth of the metering vessel (7) includes a support surface upon which the sealing member (9) is supported.

29. The dispenser as claimed in claim 24, wherein the support surface is formed with a recess at the foot of the first outwardly-flared portion (24).

30. The dispenser as claimed in claim 29, wherein said recess takes the form of an annular groove.

31. The dispenser as claimed in claim 24, wherein said support surface is formed integrally with said metering vessel (7).

32. The dispenser as claimed in claim 24, wherein said support surface is the upper surface of a support ring (13) positioned within said metering vessel (7) and said recess is a space (20) between juxtaposed surfaces of said support ring (13) and said metering vessel (7).

33. The dispenser as claimed in claim 6, wherein said support surface is formed with a radiussed shoulder (23).

34. The dispenser as claimed in claim 7, wherein said support surface is formed with a radiussed shoulder (23).

35. The dispenser as claimed in claim 8, wherein said support surface is formed with a radiussed shoulder (23).

36. The dispenser as claimed in claim 9, wherein said support surface is formed with a radiussed shoulder (23).

37. The dispenser as claimed in claim 10, wherein said support surface is formed with a radiussed shoulder (23).

38. The dispenser as claimed in claim 11, wherein said support surface is formed with a radiussed shoulder (23).

* * * * *